US008911256B2

(12) United States Patent
Qiao et al.

(10) Patent No.: US 8,911,256 B2
(45) Date of Patent: Dec. 16, 2014

(54) GASKET FOR AN EMI CONNECTOR

(75) Inventors: YunLong Qiao, West Coast Park (SG); Saujit Bandhu, Anchorvale (SG)

(73) Assignee: 3M Innovative Properties Company, St. Paul, MN (US)

( * ) Notice: Subject to any disclaimer, the term of this patent is extended or adjusted under 35 U.S.C. 154(b) by 89 days.

(21) Appl. No.: 13/881,031

(22) PCT Filed: Nov. 17, 2011

(86) PCT No.: PCT/US2011/061117
§ 371 (c)(1), (2), (4) Date: Apr. 23, 2013

(87) PCT Pub. No.: WO2012/071236
PCT Pub. Date: May 31, 2012

(65) Prior Publication Data
US 2013/0231005 A1 Sep. 5, 2013

(30) Foreign Application Priority Data
Nov. 23, 2010 (SG) ..... 201008673-4

(51) Int. Cl.
*H01R 13/648* (2006.01)
*H01R 13/6581* (2011.01)
*H01R 13/6582* (2011.01)

(52) U.S. Cl.
CPC ..... *H01R 13/6581* (2013.01); *H01R 13/6582* (2013.01)
USPC ..... 439/607.18

(58) Field of Classification Search
CPC ..... H01R 13/65802; H01R 13/6581
USPC ..... 439/607.18–607.21
See application file for complete search history.

(56) References Cited

U.S. PATENT DOCUMENTS

| | | | | |
|---|---|---|---|---|
| 6,655,995 | B1 | 12/2003 | Reisinger et al. | |
| 6,893,294 | B2 | 5/2005 | Moriyama et al. | |
| 7,303,336 | B2 * | 12/2007 | Kayner et al. | 385/55 |
| 7,438,564 | B2 * | 10/2008 | Lloyd | 439/92 |
| 7,438,596 | B2 | 10/2008 | Phillips | |
| 7,517,160 | B2 * | 4/2009 | Miyoshi et al. | 385/92 |
| 7,559,800 | B2 * | 7/2009 | Wu | 439/607.3 |
| 7,566,245 | B1 * | 7/2009 | McColloch | 439/607.2 |
| 7,566,246 | B2 * | 7/2009 | Moore et al. | 439/607.01 |

(Continued)

FOREIGN PATENT DOCUMENTS

| | | |
|---|---|---|
| JP | 2000-347767 | 12/2000 |
| JP | 2005-275407 | 10/2005 |

OTHER PUBLICATIONS

PCT International Search Report from PCT/US2011/061117, dated May 29, 2012, 3 pages.

*Primary Examiner* — Ross Gushi
(74) *Attorney, Agent, or Firm* — Robert S. Moshrefzadeh

(57) ABSTRACT

A gasket 102 for an Electromagnetic Interference (EMI) connector 100 comprising a first conductive part 104 including a plurality of spring tabs 108, a second conductive part 106 including a plurality of spring tabs 108, wherein the first conductive part 104 is configured to engage a first connector piece 110 and the second conductive part 106 is configured to engage a second connector piece 112, wherein the first conductive part is configured to engage the second conductive part when the first connector piece 110 is attached to the second connector piece 112, and wherein the spring tabs 108 are configured to electrically connect the connector 100 to an EMI shielding cage.

15 Claims, 13 Drawing Sheets

(56) References Cited

U.S. PATENT DOCUMENTS

| | | | | |
|---|---|---|---|---|
| 7,597,590 | B2 * | 10/2009 | McColloch | 439/607.18 |
| 7,771,225 | B1 * | 8/2010 | Wu | 439/352 |
| 7,802,929 | B2 * | 9/2010 | Moore et al. | 385/92 |
| 7,898,808 | B2 * | 3/2011 | Joiner et al. | 361/707 |
| 7,928,324 | B2 * | 4/2011 | Moore | 174/354 |
| 7,955,003 | B2 * | 6/2011 | Teo et al. | 385/92 |
| 7,957,159 | B2 * | 6/2011 | Wu | 361/818 |
| 8,035,975 | B2 * | 10/2011 | Wu | 361/747 |
| 8,064,207 | B2 * | 11/2011 | Wu | 361/747 |
| 8,475,210 | B2 * | 7/2013 | Wang et al. | 439/607.31 |
| 8,480,432 | B2 * | 7/2013 | Wu | 439/607.18 |
| 8,500,470 | B2 * | 8/2013 | Wang et al. | 439/159 |
| 8,506,331 | B2 * | 8/2013 | Wu | 439/607.18 |
| 8,523,595 | B2 * | 9/2013 | Wu | 439/352 |
| 8,537,558 | B2 * | 9/2013 | Su et al. | 361/747 |
| 8,550,848 | B2 * | 10/2013 | Wu | 439/607.18 |
| 8,562,373 | B2 * | 10/2013 | Wu | 439/352 |
| 8,597,045 | B2 * | 12/2013 | Zhu et al. | 439/357 |
| 8,599,567 | B2 * | 12/2013 | Wu | 361/752 |
| 8,668,515 | B2 * | 3/2014 | Wu | 439/352 |
| 8,787,025 | B2 * | 7/2014 | Wu | 361/740 |
| 8,834,205 | B2 * | 9/2014 | Fogg et al. | 439/607.21 |
| 2003/0160396 | A1 | 8/2003 | Dean | |
| 2006/0215968 | A1 * | 9/2006 | Kayner et al. | 385/89 |
| 2007/0117458 | A1 * | 5/2007 | Winker et al. | 439/607 |
| 2007/0178762 | A1 | 8/2007 | Dunwoody et al. | |
| 2008/0207039 | A1 * | 8/2008 | Moore et al. | 439/346 |
| 2009/0147493 | A1 * | 6/2009 | Wu | 361/818 |
| 2009/0156058 | A1 * | 6/2009 | Wu | 439/607.18 |
| 2010/0091466 | A1 * | 4/2010 | Wu | 361/747 |
| 2010/0091467 | A1 * | 4/2010 | Wu | 361/747 |
| 2011/0003502 | A1 * | 1/2011 | Li et al. | 439/464 |
| 2012/0164860 | A1 * | 6/2012 | Wang et al. | 439/159 |
| 2012/0190223 | A1 * | 7/2012 | Wu | 439/152 |
| 2012/0190224 | A1 * | 7/2012 | Wu | 439/157 |
| 2012/0214324 | A1 * | 8/2012 | Wu | 439/271 |
| 2012/0214345 | A1 * | 8/2012 | Wu | 439/607.19 |
| 2012/0214350 | A1 * | 8/2012 | Wu | 439/676 |
| 2012/0218720 | A1 * | 8/2012 | Wu | 361/740 |
| 2012/0220152 | A1 * | 8/2012 | Wu | 439/350 |
| 2013/0231005 | A1 * | 9/2013 | Qiao et al. | 439/607.55 |

* cited by examiner

GASKET FOR AN EMI CONNECTOR

FIELD

The present invention relates to a gasket for an Electromagnetic Interference (EMI) connector plug.

BACKGROUND

It is a common practice to connect a cable to a printed circuit board (PCB) by utilizing a plug connector at an end of the cable which is intended for insertion into an opposing mating connector. The mating connector is typically mounted on the PCB placed within a housing of an electronic device. There may be other electronic modules mounted on the PCB. Each electronic module may emit EMI that can interfere and negatively influence the signals transmission between the connectors.

The mating connector may be shielded from EMI by using a metal shielding cage (or sometimes referred to as EMI shielding cage) that is also mounted on the PCB and which surrounds the mating connector in the electronic device. However, even with the use of the cage, EMI may still be present.

In order reduce EMI, it is common to include a conductive gasket on the plug connector to electrically connect or ground the metal casing of the plug connector to the EMI shielding cage. This gasket typically takes the form of a metal spring. During manufacturing an extra step of embossing is required to lock the spring onto the outside of the plug connector. This extra step of embossing may add cost and/or time to the manufacturing process. Further if the plug connector needs to be disassembled for any purpose, the metal spring must be destroyed, and a new one embossed once the plug connector is reassembled.

For the benefit of consumers, standards have been established within the electronics industry, especially in the areas of connector mechanical interfaces, signal and data transmission protocols, and signal and data exchange protocols. This interoperability will allow an electronic module that is made by one vendor to be replaceable with a similar module from another vendor. Thus, consumers will have more product choices and can benefit from this competition with more competitive device pricing.

In the electronics industry, there are many standards committees including but not limited to, the Institute of Electric and Electronic Engineers ("IEEE") Committee which govern the specifications for data communication, the T10 Committee which defines the standards for data storage, and the Small Form Factor ("SFF") Committee which specifies the standards for mechanical interfaces for connectors. SFF 8088 is one such standard set by the SFF Committee and it is a specification for mini multi-lane shielded connectors.

SUMMARY

In general terms the invention proposes a 2 part gasket, where each part clips into a respective piece of an EMI plug connector. This may have the advantage that embossing is not required and/or the gasket does not need to be replaced if the plug connector is disassembled.

According to a first specific expression of the invention there is provided a gasket for an Electromagnetic Interference (EMI) connector comprising a first conductive part including a plurality of spring tabs, a second conductive part including a plurality of spring tabs, wherein the first conductive part is configured to engage a first connector piece and the second conductive part is configured to engage a second connector piece, wherein the first conductive part is configured to engage the second conductive part when the first connector piece is attached to the second connector piece, and wherein the spring tabs are configured to electrically connect the connector to an EMI shielding cage.

The first conductive part may be configured to lock with the second conductive part when the first connector piece is attached to the second connector piece.

The first conductive part may comprise a tongue and the second conductive part comprises a matching slot into which the tongue is configured to mate.

The first conductive part may includes a main section, two side sections, and two protrusion walls extending inwardly from the side section, and wherein the main section, each side wall and protrusion tab are configured to clip onto the first connector piece.

The tongue may extend from the protrusion wall.

The second conductive part may include a main section, two side sections, and two edge tabs extending inwardly from the side sections, and wherein the main section, each side wall and edge tab are configured to clip onto the second connector piece.

The slot may be provided in the edge tab.

The spring tabs may extend from the main section and the two side sections of the first conductive part and the second conductive part.

The first conductive part may include an aperture configured to mate with a protrusion on the first connector piece to aid alignment.

The second conductive part may include a detent to aid alignment.

Each spring tab may include an outwardly extending portion, a parallel portion and an inwardly extending portion.

According to a second specific expression of the invention there is provided an Electromagnetic Interference (EMI) connector comprising:

a first connector piece, a second connector piece, and a gasket according to anyone of claims 1 to 11 engaged to the first connector piece and the second connector piece.

A protrusion on the first connector piece may be configured to mate with the aperture.

A recess in the first connector piece may be configured to accommodate the first conductive part to aid alignment.

A recess in the second connector piece may be configured to accommodate the second conductive part to aid alignment.

BRIEF DESCRIPTION OF THE DRAWINGS

In order that the invention may be fully understood and readily put into practical effect there shall now be described by way of non-limitative example only, exemplary embodiments described below with reference to the accompanying illustrative drawings in which.

DETAILED DESCRIPTION

Figure 1B:
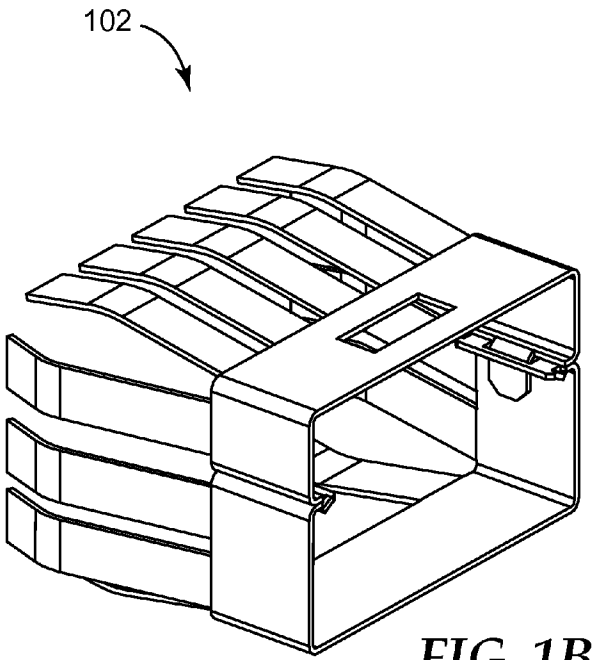
FIG. 1B is an alternative view of the gasket in FIG. 1A.
Figure 1A:
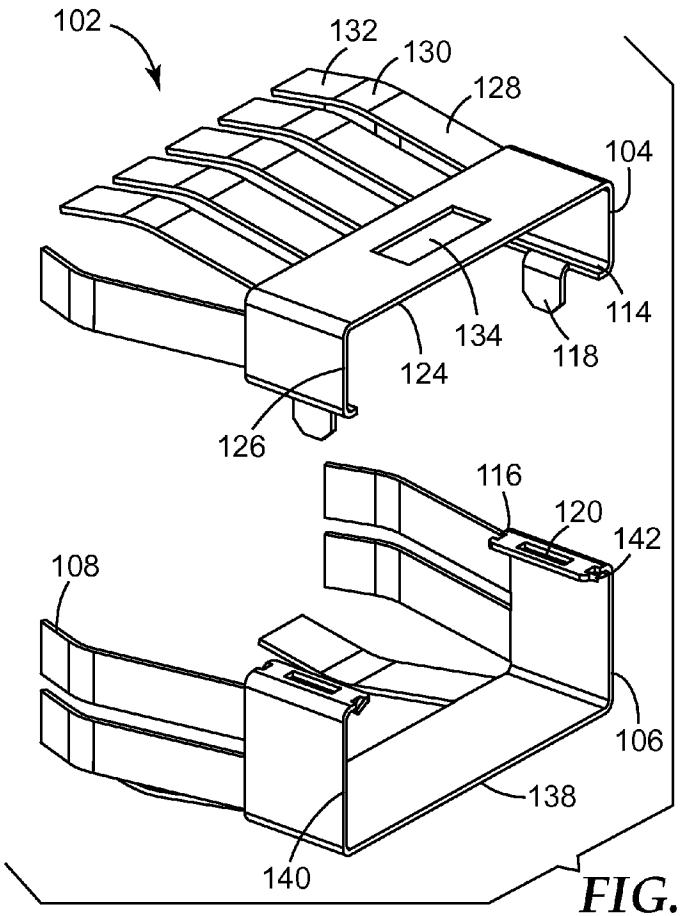
FIG. 1A is a perspective view of a gasket according to a first exemplary embodiment of the present invention.
Figure 2A:
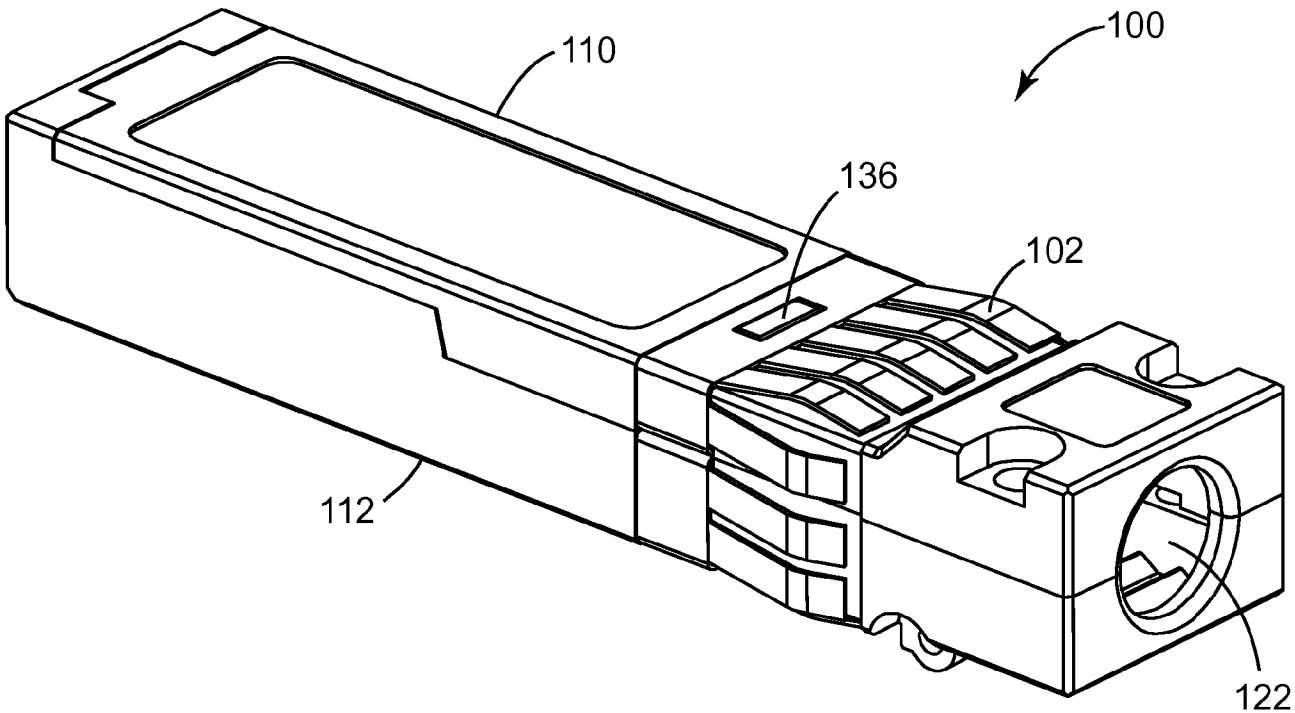
FIG. 2A is a perspective view of the gasket in FIG. 1B on an EMI plug connector.
Figure 2B:
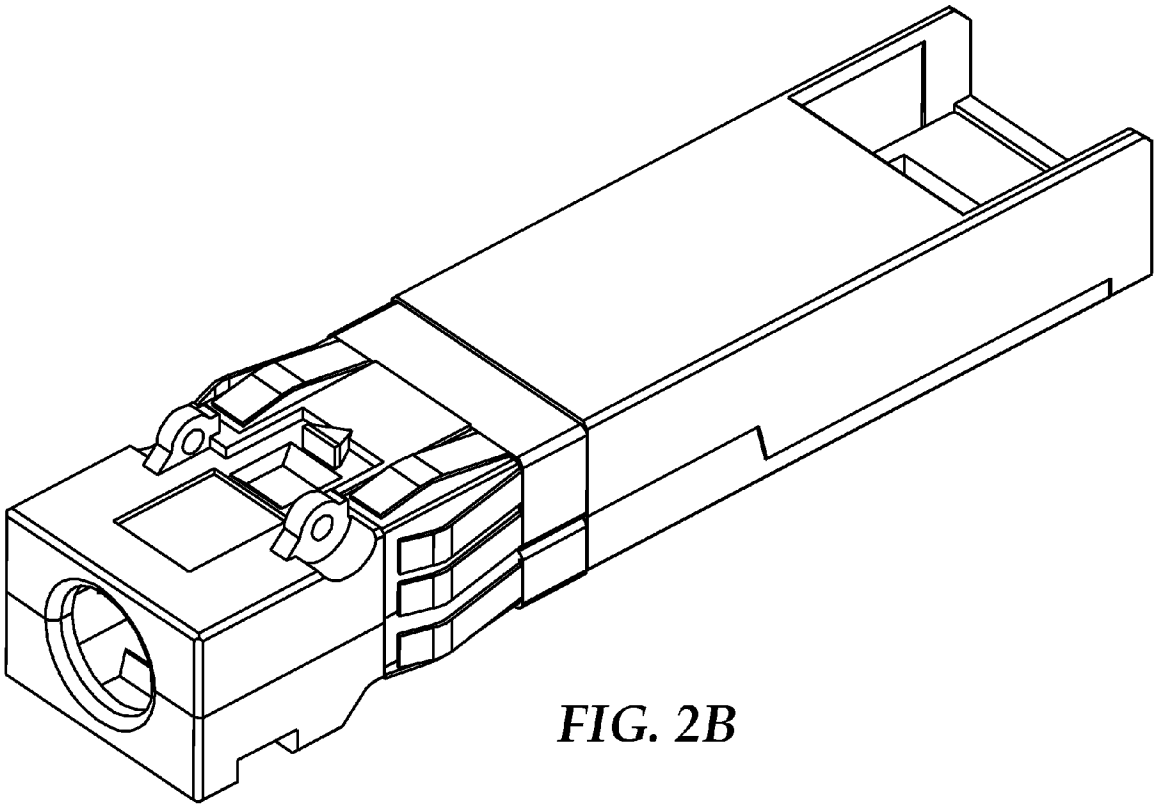
FIG. 2B is an alternative perspective view of the gasket in FIG. 1B on an EMI plug connector.
Figure 3:
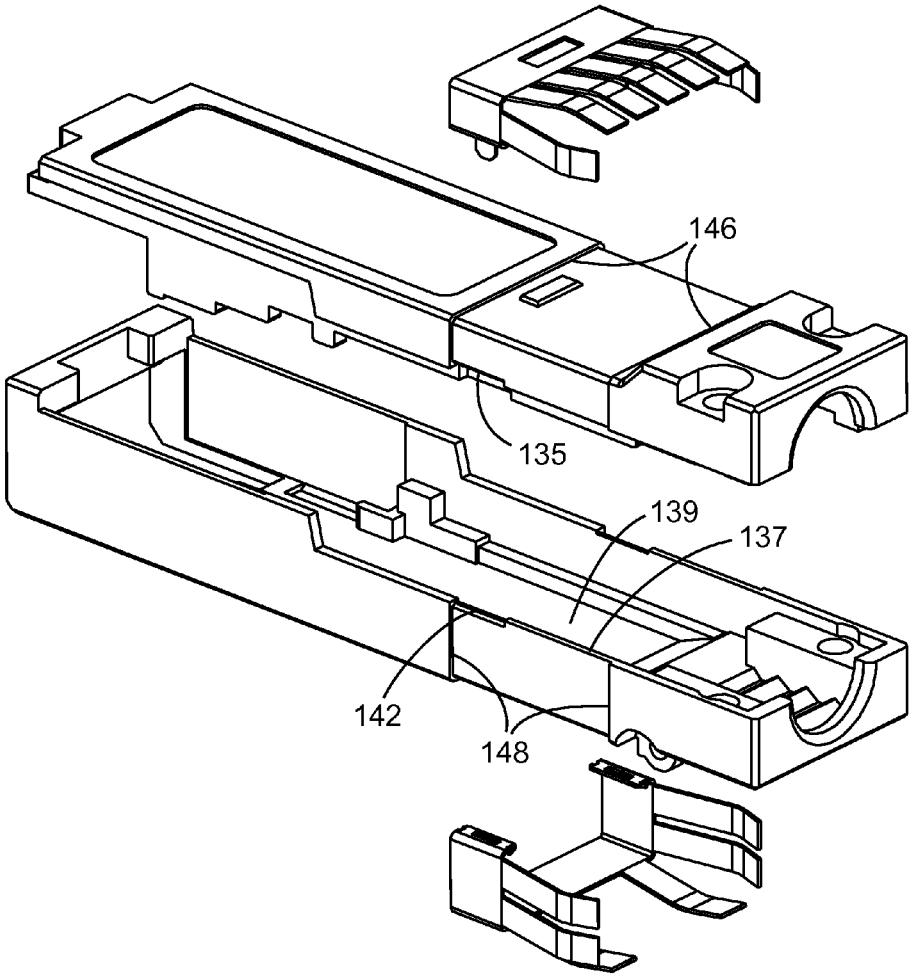
FIG. 3 is an exploded view of FIG. 2B.

FIGS. 1A to 3 show a first exemplary embodiment of a gasket for an Electromagnetic Interference (EMI) plug connector 100. The plug connector 100 includes an upper piece 110 and a lower piece 112. During manufacturing a cable is inserted through aperture 122 and soldered or attached to internal contacts. Then the upper piece 110 and the lower piece 112 are each mated and bolted together to form the plug connector 100.

The plug connector 100 includes a gasket 102 to minimize EMI, and/or to electrically connect or ground the metal casing of the plug connector 100 to an EMI shielding cage. The gasket includes two parts: an upper part 104 and a lower part 106. Before the plug connector 100 is bolted together, the upper part 104 is clipped around the upper plug connector piece 110 and the lower part 106 is clipped around the lower plug connector piece 112. Each gasket part is then locked in place once the pieces are bolted together. This may avoid the need for embossing and/or may avoid the need for gasket replacement if the plug connector is subsequently disassembled.

The upper gasket part 104 includes a main portion 124 and two side portions 126. Five spring tabs 108 extend from the main portion 124 and one spring tab extends from each of the two side portions 126. Each spring tab 108 includes an outwardly angled portion 128, a parallel portion 130 and an inwardly angled portion 132. The spring tabs 108 are approximately evenly spaced. The spring tabs are stamped from a steel blank, folded into the required shape and then tempered to obtain an appropriate spring constant. In the unbiased state, the parallel portion 130 is spaced from the side of the upper plug connector piece 110.

An aperture 134 in the main portion 124 mates with a protrusion 136 on the upper plug connector piece 110. Two protrusion tabs 114 extend inwardly from the two side portions. Each protrusion tab 114 includes a tongue 118 which is inset past an inner lip 137 of the lower plug connector piece 112 so that it extends downwardly into an internal cavity 139 of the lower plug connector piece 112. Each protrusion tab 114 is seated in a recess 135 in the upper plug connector piece 110. The upper gasket part 104 is housed with a recess 146 extending around the three external sides of the upper plug connector piece 110. The aperture 134, recess 135 and/or recess 146 serve to align the upper gasket part 104.

The lower gasket part 106 includes a main portion 138 and two side portions 140. One spring tab extends from each end of the main portion 138 and two spring tabs extend from each of the side portions 140.

Two edge tabs 116 extend inwardly from the side portions 140. Each edge tab 116 includes a slot 120 which mates with the tongue 118 when the upper plug connector piece 110 is bolted to the lower plug connector piece 112. Each edge tab 116 is seated in a recess 140 in the lip 137. Each edge tab 116 has a detent 144 which clips on the inside the lip 137. The lower gasket part 106 is housed with a recess 148 extending around the three external sides of the lower plug connector piece 112. The recess 140, the detents 144 and/or recess 148 serve to align the lower gasket part 106.

Figure 4:
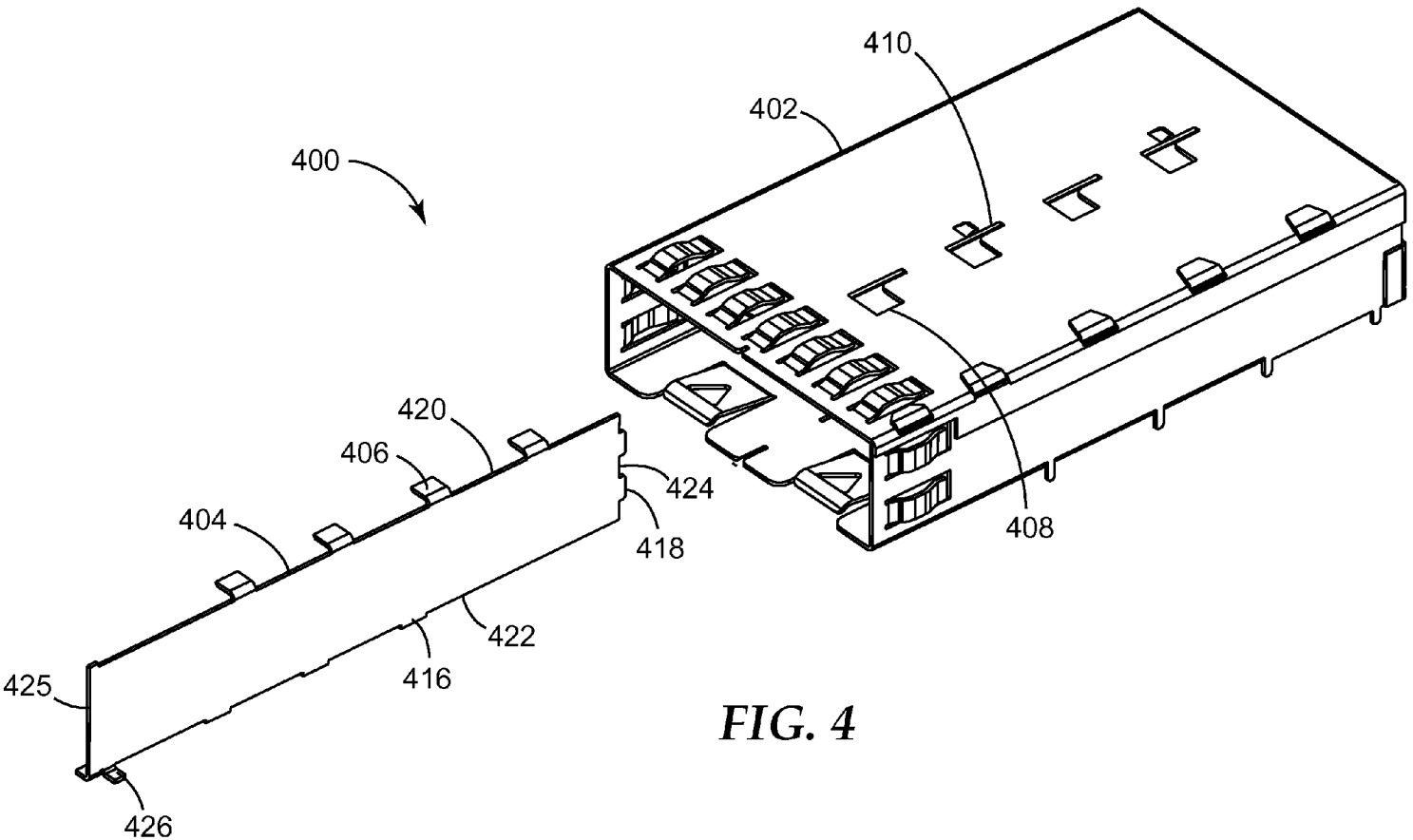
FIG. 4 is an exploded view of an EMI shielding cage according to a second exemplary embodiment of the present invention.
Figure 5:
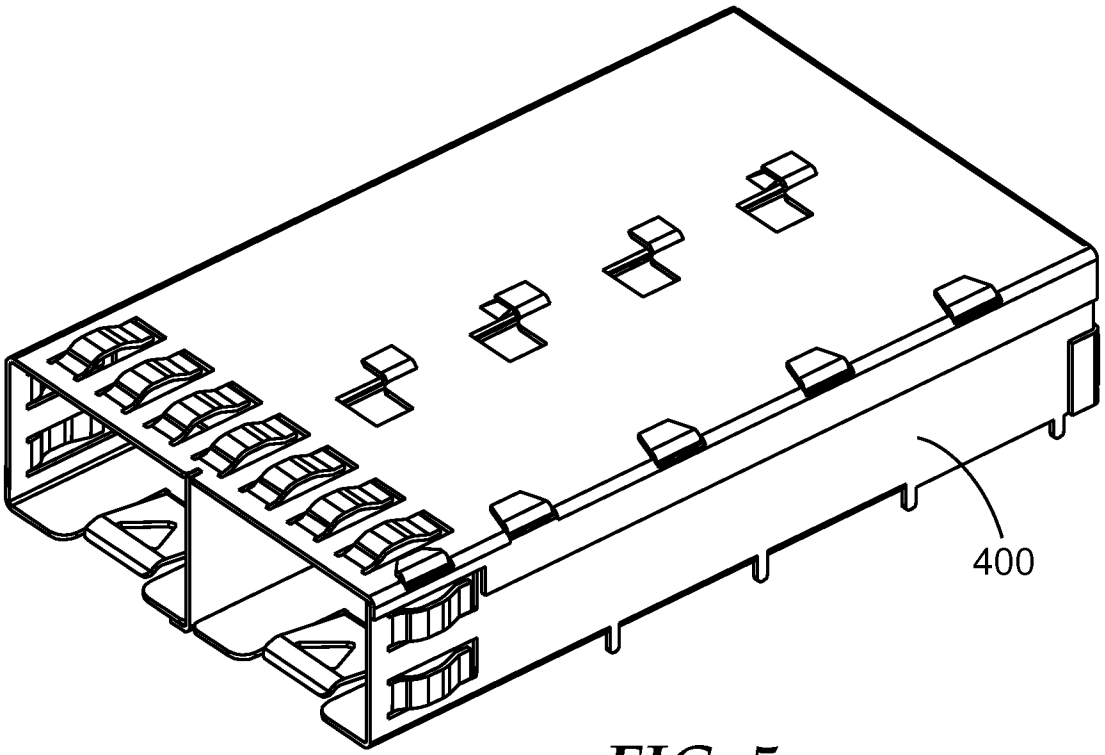
FIG. 5 is a perspective view of the cage in FIG. 4.
Figure 11:
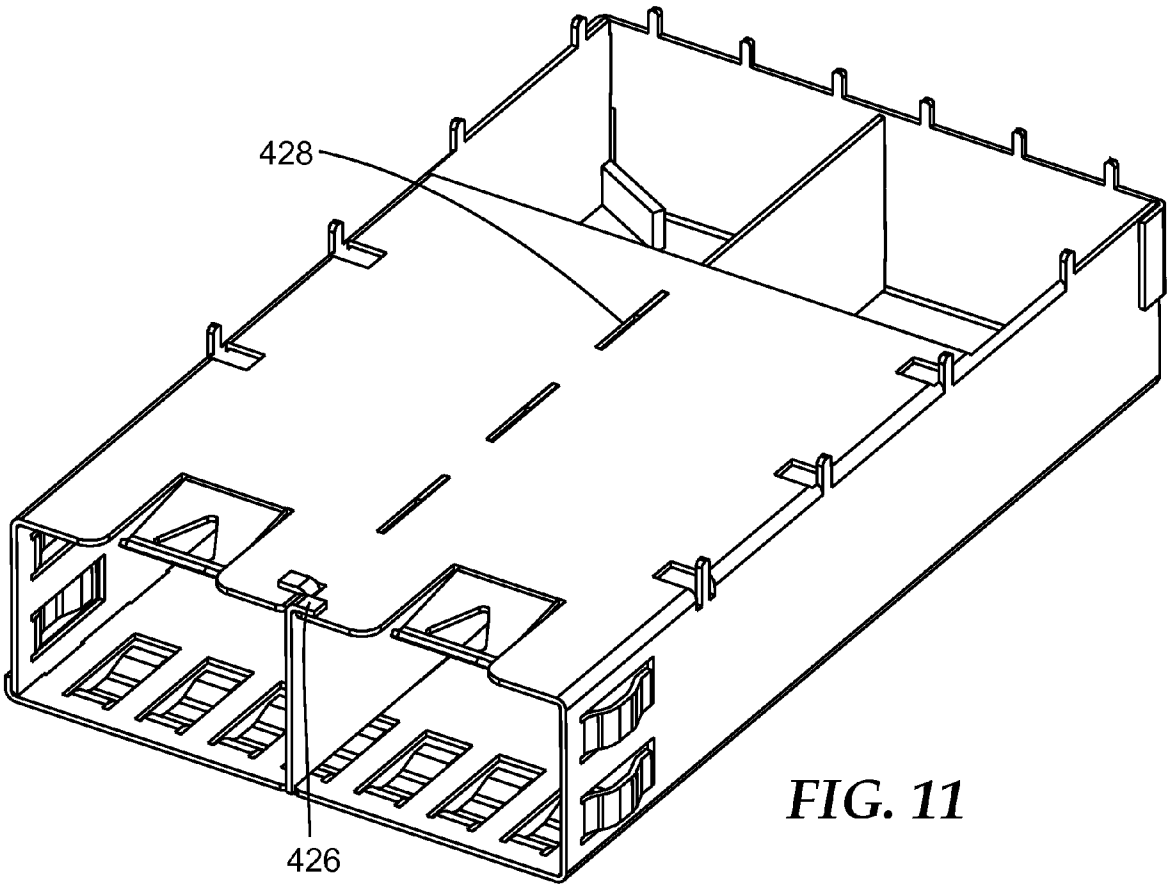
FIG. 11 is an alternative exploded view of FIG. 4.
Figure 12:
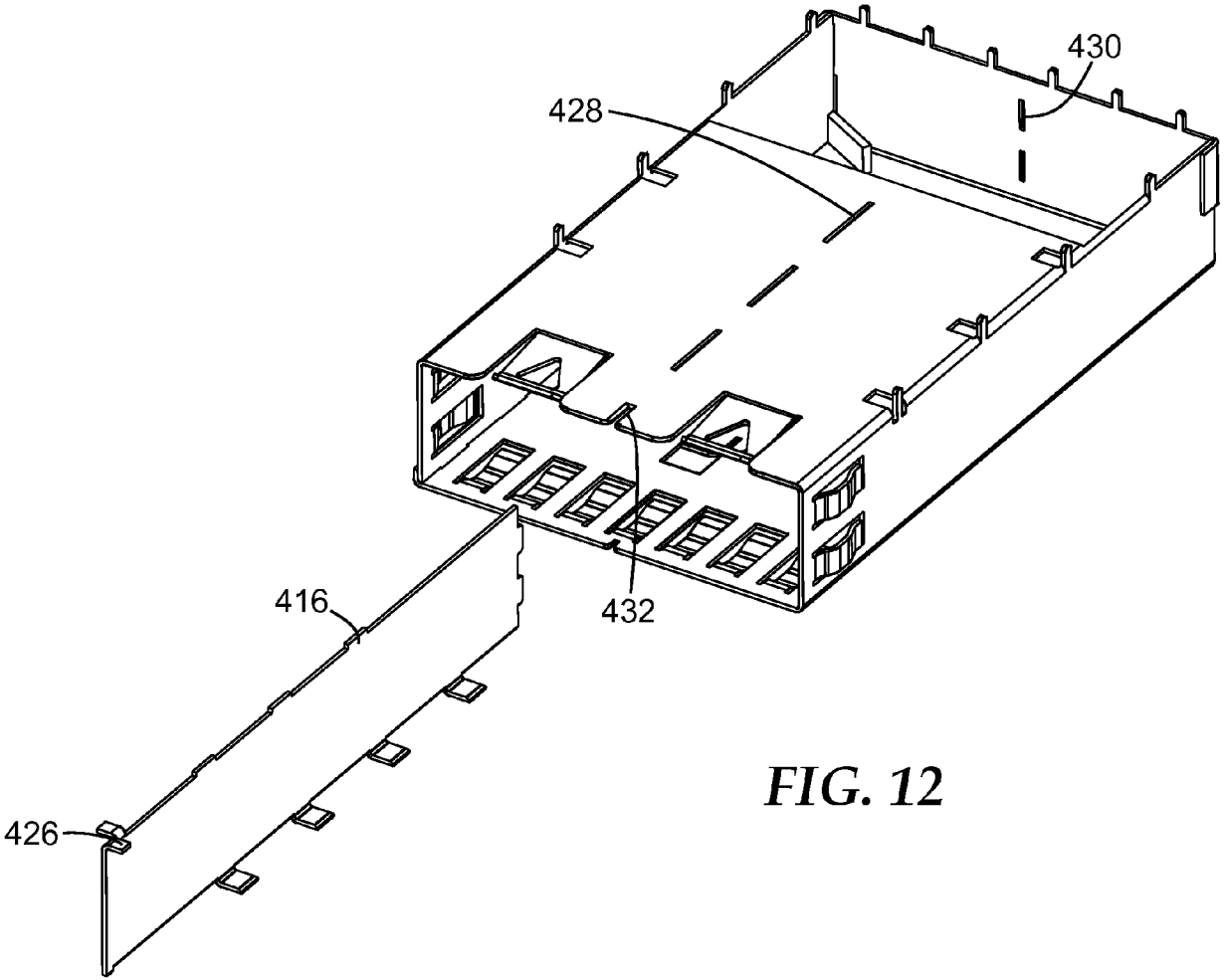
FIG. 12 is alternative perspective view of the cage in FIG. 4.

FIGS. 4, 5, 11 and 12 show a second example embodiment of an EMI shielding cage assembly 400. A conductive separator 404 includes perpendicular tabs 406 on its top edge 404, straight tabs 416 on its bottom edge 422, and straight tabs 418 on its end 424. A locking tab 426 is also located on the bottom edge 422 near the front 425. The conductive separator 404 rotates into place within outer conductive cover 402, so that the through windows 408 and bottom tabs 416 engage slots 428. Next the conductive separator 404 is slid forward into a locking position so that top tabs 406 engage locking slots 410, end tabs 418 engage end slots 430 and locking tabs 426 engage front notch 432. The locking tab 426 includes two perpendicular tabs extending in opposite directions. This may have the advantage of avoiding the separate step of bending the tabs on the separator once located to lock it in position.

Figure 6:
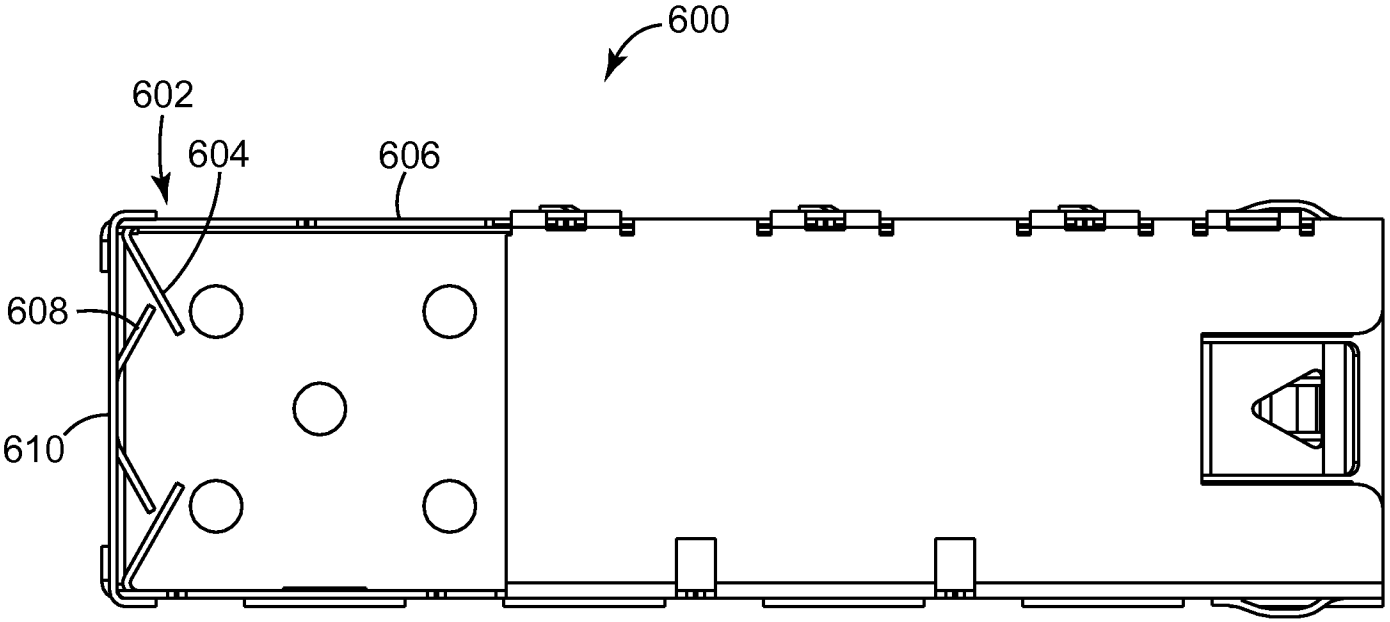
FIG. 6 is a bottom view of an EMI shielding cage according to a third exemplary embodiment of the present invention.
Figure 7:
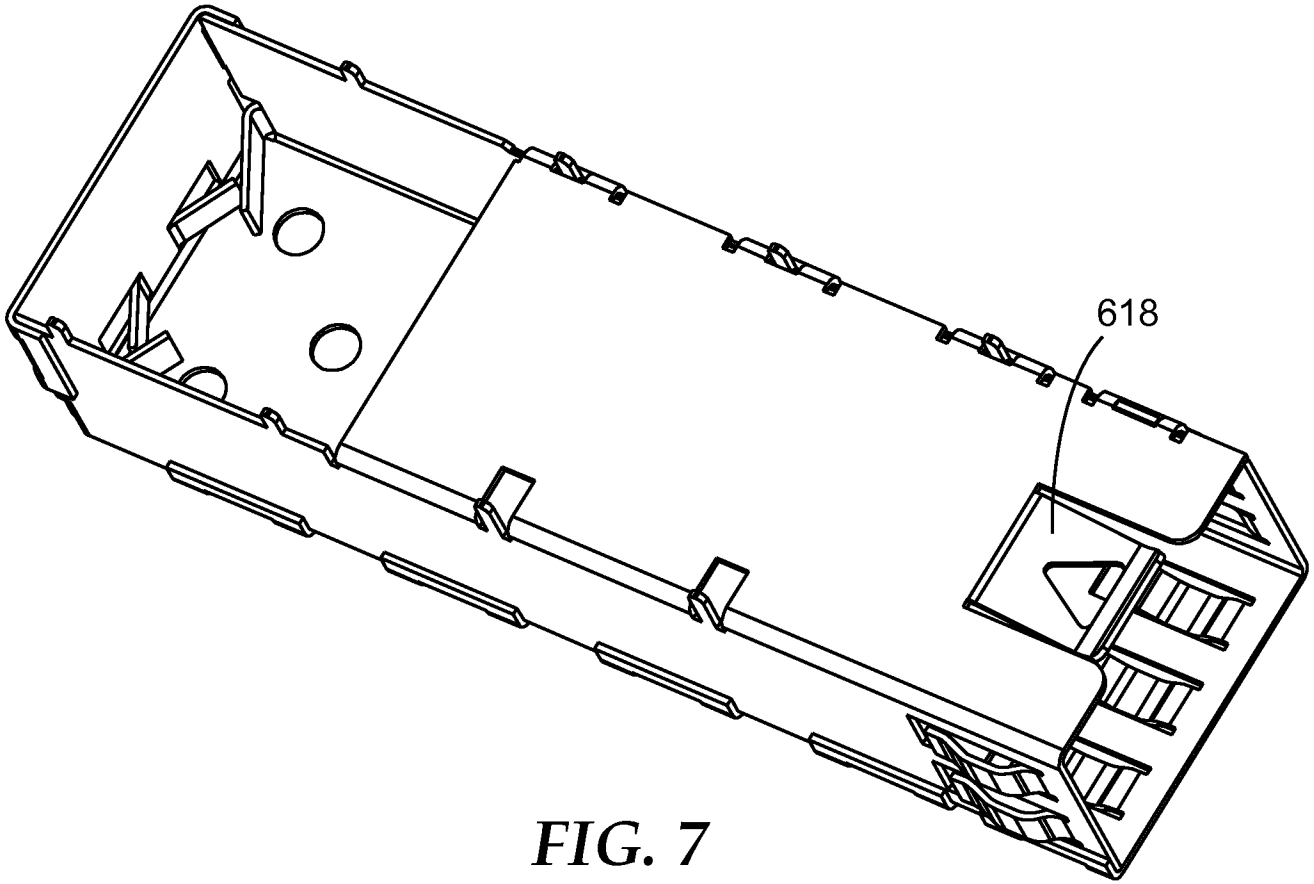
FIG. 7 is a perspective view of the cage in FIG. 6.
Figure 8:
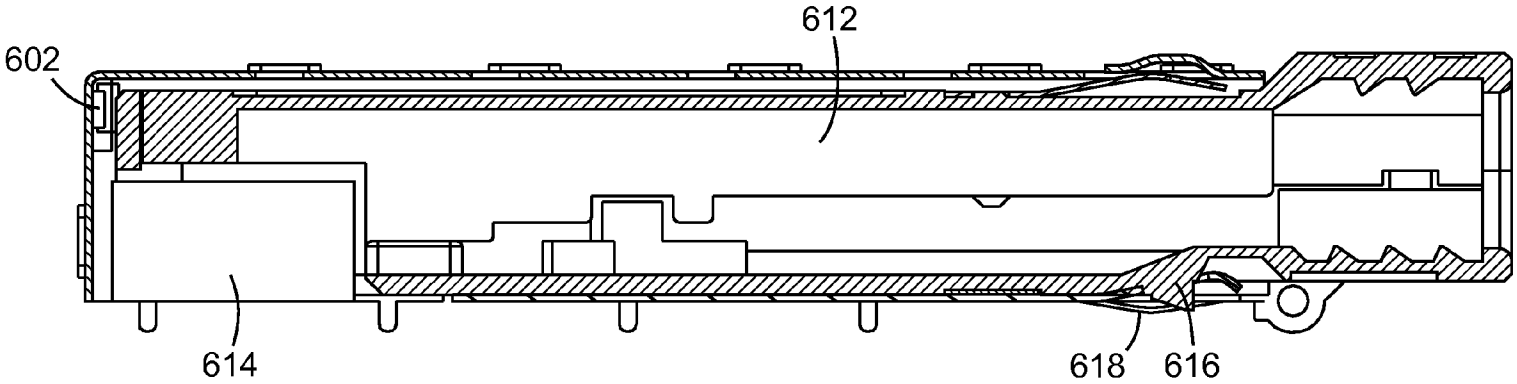
FIG. 8 is a cross section view of the cage in FIG. 6 with a plug connector engaged.
Figure 9:
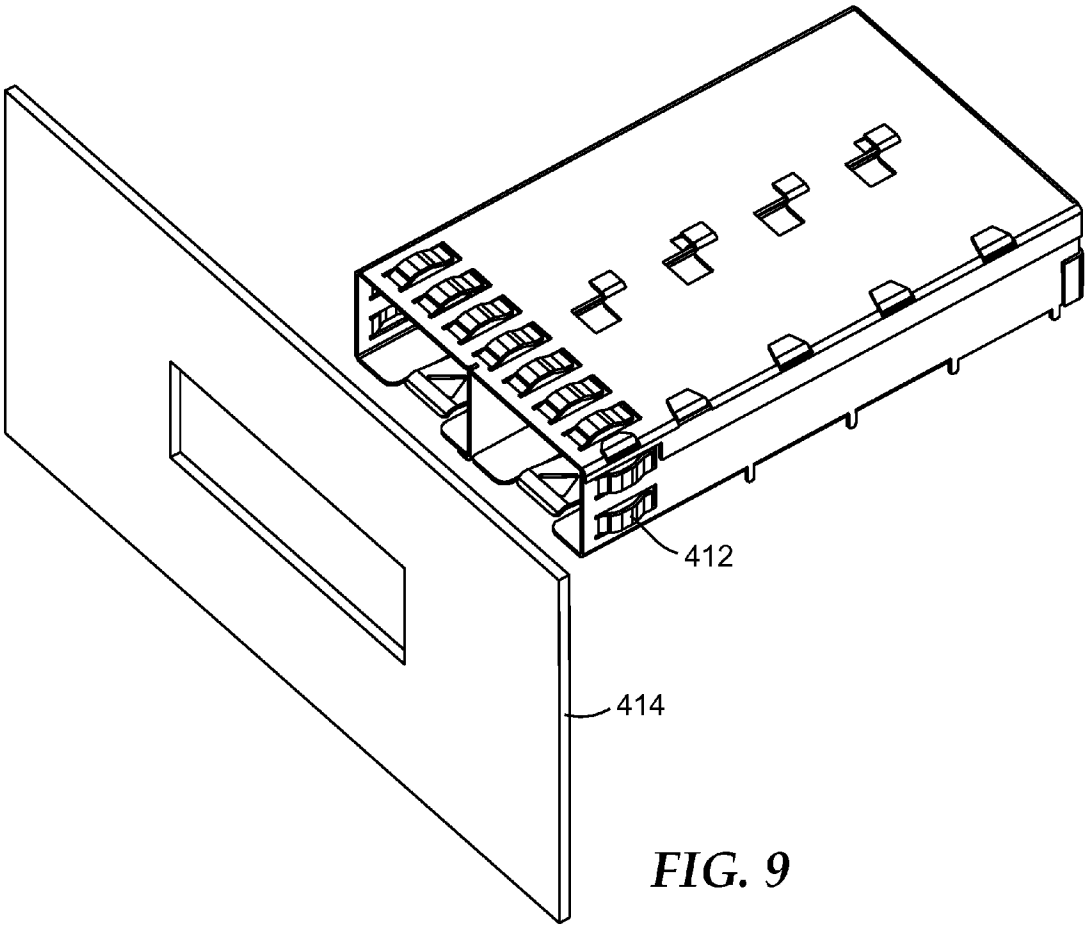
FIG. 9 is an exploded view of the cage in FIG. 6 and a face plate.
Figure 10:
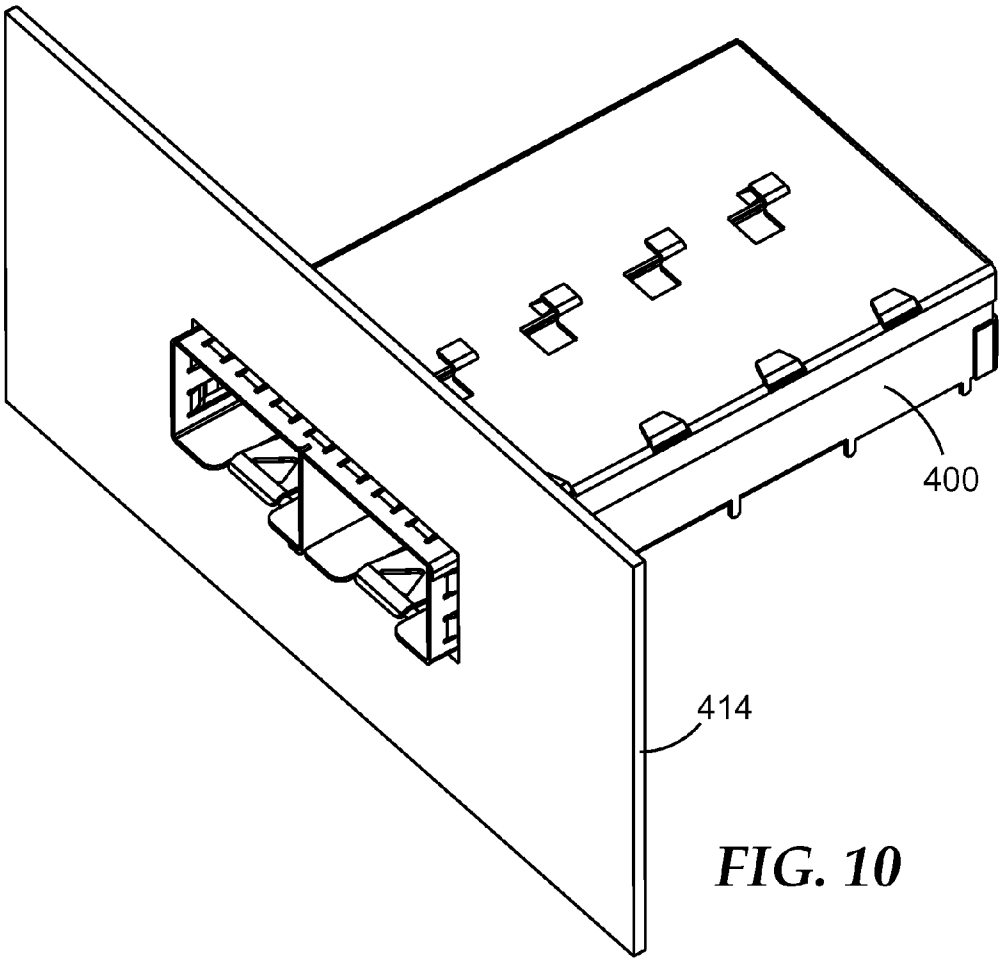
FIG. 10 is a perspective view of the cage and face plate in FIG. 9.

FIGS. 6 to 10 show a third example embodiment of an EMI shielding cage 600. A deflector 602 is provided with a first arm 604 and a second arm 608 to provide a restoring force against a plug connector 612, to assist with un-mating the connector. The first arm 604 may be bent from the side wall 606 of the cage 600. The second arm 608 may be bent from the end wall 610 of the cage 600. When the plug connector 612 is inserted, it contacts and deflects the first arm which in turn contacts and deflects the second arm as its mates with connector 614. It is then locked in place by the locking tab 616 engaging latch 618. This may have the advantage that the restoring force provided is higher than with a single arm. This additional restoring force makes it easier to un-mate the plug connector when the latch 618 is unfastened.

Following are embodiments of a gasket for an Electromagnetic Interference (EMI) connector according to aspects of the present invention.

Embodiment 1: A gasket for an Electromagnetic Interference (EMI) connector comprising a first conductive part including a plurality of spring tabs, a second conductive part including a plurality of spring tabs, wherein the first conductive part is configured to engage a first connector piece and the second conductive part is configured to engage a second connector piece, wherein the first conductive part is configured to engage the second conductive part when the first connector piece is attached to the second connector piece, and wherein the spring tabs are configured to electrically connect the connector to an EMI shielding cage.

Embodiment 2: The gasket in embodiment 1 wherein the first conductive part is configured to lock with the second conductive part when the first connector piece is attached to the second connector piece.

Embodiment 3: The gasket in embodiment 2 wherein the first conductive part comprises a tongue and the second conductive part comprises a matching slot into which the tongue is configured to mate.

Following are embodiments of An Electromagnetic Interference (EMI) connector according to aspects of the present invention.

Embodiment 1: An Electromagnetic Interference (EMI) connector comprising:

a first connector piece, a second connector piece, and a gasket according to anyone of embodiments 1 to 3 engaged to the first connector piece and the second connector piece.

Following are embodiments of Electromagnetic Interference (EMI) shielding cage according to aspects of the present invention.

Embodiment 1: An Electromagnetic Interference (EMI) shielding cage 400 comprising:

an outer conductive cage 402 having a openings configured to receive a plurality of connectors, each connector being located in a bay, a conductive partition 404 configured to separate two adjacent bays within the cage 402, at least one first tab 406 extending substantially perpendicularly from a first edge 420 of the partition, at least one second tab 416 extending from a second edge 422 of the partition, wherein the second edge 422 is substantially opposed to the first edge 420, the first tab 406 is configured to be rotated into a matching window 408 in the cage.

Embodiment 2: The cage in embodiment 1 further comprising at least one third tab 418 substantially extending from a third edge 424 of the partition configured to engage with a matching slot in the cage.

Embodiment 3: The cage in embodiment 2 wherein the first tab 406, the second tab 416 and the third tab 418 are configured so that once the first tab 406 has been rotated into the window 408, the first tab 406, the second tab 416 and the third tab 418 substantially simultaneously slide into the matching slots 410 to substantially lock the partition 404 in place in the cage 402.

Embodiment 4: An Electromagnetic Interference (EMI) shielding cage comprising:

an outer conductive cover 600 having a slot configured to receive a plug connector 612 and an opening for a mating connector 614, and a deflector 602 substantially adjacent the opening, the deflector including a first arm 604 extending from a side 606 of the cover 600 respectively, and a second arm 608 extending from an end 610 of the cover 600, wherein the deflector 602 is configured to provide a restoring force against the plug connector 612 when engaged within the cover 600.

Embodiment 5: The cage in embodiment 4 wherein an end of the second arm 608 is configured to be substantially adjacent to, or touch, the first arm 604, when the plug connector 612 and the cover 600 are in an unmated configuration.

Embodiment 6: The cage in embodiment 4 or 5 wherein when the plug connector is inserted, it contacts and deflects the first arm which in turn contacts and deflects the second arm.

Embodiment 7: The cage in embodiment 6 wherein a substantial portion of the second arm 608 is configured to touch the first arm 604 when the plug connector 612 is mated within the cover 600.

Following are embodiments of Electromagnetic Interference (EMI) shielding cage according to aspects of the present invention.

Embodiment 1: An Electromagnetic Interference (EMI) shielding assembly comprising a cage 600 according to anyone of embodiments 4 to 7, and a plug connector 612 configured to engage within the cage and to receive the restoring force.

Embodiment 2: The assembly in embodiment 1 further comprising a mating connector 614 may be configured to electrically connect to the plug connector 612.

Whilst there has been described in the foregoing description embodiments of the present invention, it will be understood by those skilled in the technology concerned that many variations in details of design, construction and/or operation may be made without departing from scope as claimed.

REFERENCE NUMERALS

100 plug shield/plug connector
102 gasket
104 upper gasket part
106 lower gasket part
108 spring tabs
110 upper connector piece
112 lower connector piece
114 protrusion tab
116 edge tab
118 tongue
120 slot
122 cable aperture
124 upper gasket piece main portion
126 upper gasket piece side portion
128 outward angled portion
130 parallel portion
132 inward angled portion
134 alignment aperture
135 upper alignment recess
136 alignment protrusion
137 lower gasket part lip
138 lower gasket piece main portion
139 lower gasket part cavity
140 lower gasket piece side portion
142 lower alignment recess
144 alignment detent
146 upper gasket recess
148 lower gasket recess
400 2× metal cage/EMI shielding cage
402 cage cover
404 mid plane
406 top metal latch
408 cage cover windows
410 locking slot
412 EMI gasket
414 rack/face plate
416 bottom metal latch
418 end metal latch
420 mid plane top edge
422 mid plane bottom edge
424 mid plane end edge
426 locking tab
428 bottom slot
430 end slot
432 front notch
600 1× cage
602 metal deflector
604 front deflector
606 side wall
608 back deflector
610 back wall
612 plug shield
614 connector
616 tab
618 latch

What is claimed is:

1. A gasket for an Electromagnetic Interference (EMI) connector comprising a first conductive part including a plurality of spring tabs, a second conductive part including a plurality of spring tabs, wherein the first conductive part is configured to engage a first connector piece and the second conductive part is configured to engage a second connector piece, wherein the first conductive part is configured to engage the second conductive part when the first connector piece is attached to the second connector piece, and wherein the spring tabs are configured to electrically connect the connector to an EMI shielding cage.

2. The gasket in claim 1 wherein the first conductive part is configured to lock with the second conductive part when the first connector piece is attached to the second connector piece.

3. The gasket in claim 2 wherein the first conductive part comprises a tongue and the second conductive part comprises a matching slot into which the tongue is configured to mate.

4. The gasket in claim 3 wherein the first conductive part includes a main section, two side sections, and two protrusion walls extending inwardly from the side section, and wherein the main section, each side wall and protrusion tab are configured to clip onto the first connection piece.

5. The gasket in claim 4 wherein the tongue extends from the protrusion wall.

6. The gasket in claim 4 wherein the second conductive part includes a main section, two side sections, and two edge tabs extending inwardly from the side sections, and wherein the main section, each side wall and edge tab are configured to clip onto the second connector piece.

7. The gasket in claim 6 wherein the slot is provided in the edge tab.

8. The gasket in claim 6 wherein the spring tabs extend from the main section and the two side sections of the first conductive part and the second conductive part.

9. The gasket in claim 1 wherein the first conductive part includes an aperture configured to mate with a protrusion on the first connector piece to aid alignment.

10. The gasket in claim 1 wherein the second conductive part includes a detent to aid alignment.

11. The gasket in claim 1 wherein each spring tab including an outwardly extending portion, a parallel portion and an inwardly extending portion.

12. An Electromagnetic Interference (EMI) connector comprising:

a first connector piece, a second connector piece, and a gasket according to claim 1 engaged to the first connector piece and the second connector piece.

13. The connector in claim 12 further comprising a protrusion on the first connector piece, configured to mate with the aperture.

14. The connector in claim 12 further comprising a recess in the first connector piece configured to accommodate the first conductive part to aid alignment.

15. The connector in claim 12 further comprising a recess in the second connector piece configured to accommodate the second conductive part to aid alignment.

* * * * *